United States Patent [19]

Welch

[11] 3,996,766

[45] Dec. 14, 1976

[54] COIN-CARRYING AND EJECTING LOCKET

[75] Inventor: Velma Welch, Sunnyvale, Calif.

[73] Assignee: Lawrence Peska Associates, Inc., New York, N.Y. ; a part interest

[22] Filed: Jan. 27, 1976

[21] Appl. No.: 652,787

[52] U.S. Cl. ..... 63/1 R; 63/18; 206/.8; 224/28 B; 232/66

[51] Int. Cl.[2] ..... A44C 25/00

[58] Field of Search ..... 63/2, 18, 1 R; 232/64, 232/65, 66; 206/.8; 224/5 L, 28 B; 221/235, 276

[56] References Cited

UNITED STATES PATENTS

| | | | |
|---|---|---|---|
| 572,691 | 12/1896 | Brenzinger et al. | 63/18 UX |
| 986,158 | 3/1911 | Florsheim | 224/5 L |
| 1,242,739 | 10/1917 | Tappan | 232/66 |
| 2,083,880 | 6/1937 | Tourot | 63/1 R |
| 2,442,546 | 6/1948 | Lipschitz et al. | 224/28 B |
| 2,511,651 | 6/1950 | Schlitz | 40/323 |
| 2,521,006 | 9/1950 | Hamilton | 224/28 B |
| 3,125,214 | 3/1964 | Merila | 206/.8 |
| 3,339,300 | 9/1967 | Bury | 63/1 R X |

FOREIGN PATENTS OR APPLICATIONS

| | | | |
|---|---|---|---|
| 1,071,303 | 12/1959 | Germany | 224/28.5 |
| 16,784 | 8/1898 | United Kingdom | 63/18 |

*Primary Examiner*—F. Barry Shay
*Attorney, Agent, or Firm*—Joel Halpern

[57] ABSTRACT

A coin carrying locket has a hollow compartment for the storage of at least one coin. A coin-receiving slot and a coin ejection slot are formed in a peripheral wall of the locket at spaced locations. A pair of springs are mounted within the locket. One of the springs biases the coin towards ejection from the ejection slot whereas the other spring prevents ejection of the coins and is pivotally mounted with a tab portion thereof extending through a wall of the locket for manipulation to permit the ejection of the coin.

5 Claims, 3 Drawing Figures

COIN-CARRYING AND EJECTING LOCKET

BACKGROUND OF THE INVENTION

The invention relates to lockets and more particularly to a coin carrying locket.

The value of coin carrying lockets has been well known for many yeas heretofore, e.g., to provide a readily available supply of coins for use in parking meters, at toll booths or for children to safely store their school lunch money. Since the use of adornments such as lockets is widespread it has been considered extremely convenient to also utilize this jewelry item for utilitarian purposes. The U.S. Pat. No. 2,511,651 issued June 13, 1950 to T. R. Schlitz discloses a coin carrying identification tag which can be carried on a key ring or chain. However, prior construction, such as the identification tag of Schlitz, required opening of the locket or coin holder for the insertion or removal of a coin. Such prior construction also were susceptible to latching difficulties which frequently led to the discarding of the locket or coin-carrying receptacle.

SUMMARY OF THE INVENTION

It is one object of the invention to provide a coin carrying locket which is attractive so as to be wearable as an article of jewelry and reliable as a storage receptacle for coins.

It is another object of the invention to provide a coin carrying locket capable of safely storing a plurality of coins and of effectively discharging coins serially when required without the need to open the locket.

Other objects and advantages of the invention will become readily apparent from the following description of the invention.

In accordance with the invention there is provided a coin-carrying locket comprising:

front and back walls and a peripherally extending wall connected therebetween to form a coin receiving and storage compartment;

a coin-receiving and a coin-ejection slot formed in spaced relation in said peripherally extending wall;

a first coin-ejection spring mounted within said compartment adapted to engage a coin stored therein and urge said coin towards said ejection slot for discharge therethrough;

a second coin-retaining spring pivotally mounted within said compartment adapted to engage a coin engaged by said coin-ejection spring and to urge the coin out of alignment with said coin-ejection slot to thereby prevent ejection of the coin through said ejection slot, said coin-retaining spring being provided at the free end thereof with a manually operable tab;

and a third slot formed in one of said walls dimensioned to permit said tab to extend therethrough and be shiftable therein, whereby manual shifting of said tab against the bias of said coin-retaining spring effects pivotal movement of said coin-retaining spring and alignment of the coin with said coin-ejection slot for discharge therethrough by said coin-ejection spring.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
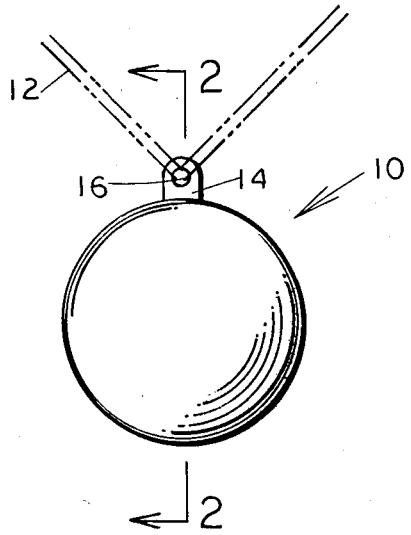
FIG. 1 is a front view of the coin-carrying locket of the invention.

Referring to the drawings there is shown a coin-carrying locket 10 suspended from a chain 12. The locket, for this purpose is provided with an upstanding ear 14 which is given an aperture 16 through which the chain is threaded. The locket may thus be worn by a person as either a bracelet or necklace.

The locket consists of front and back walls 18, 20 and with a peripherally extending wall 22 connected therebetween so as to form a coin storage compartment 24 therewithin.

Figure 2:
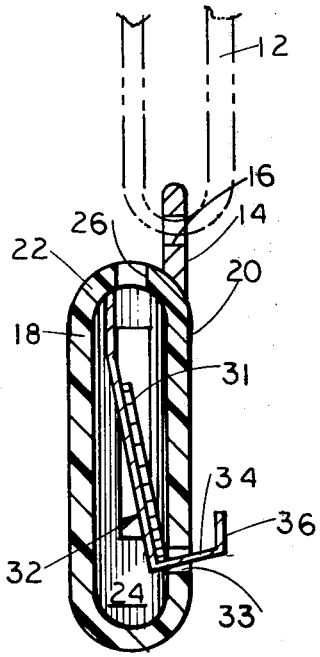
FIG. 2 is a side elevational view of the locket of FIG. 1, partly in cross-section, taken along line 2—3 thereof.
Figure 3:
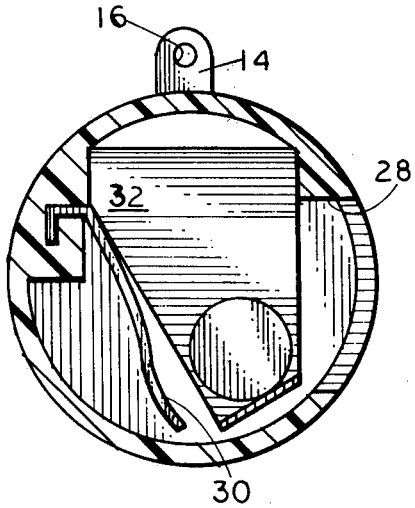
FIG. 3 is a front view of the locket shown in FIG. 1, partly in cross-section, with the front wall removed.

The peripheral wall 22 is given a coin-receiving slot 26 and a coin ejection slot 28 as shown most clearly in FIGS. 2 and 3. As shown the slots are spaced in the peripheral wall by an angular distance of substantially 90°. It will be understood, however, that this angular spacing can be varied subject to the requirement that upon insertion of a coin 31 it is positioned within compartment 24 such that spring 30, to be hereinafter described, exerts a biasing force thereon which tends to urge the coin towards ejection from slot 28 and spring 32 engages a face of the coin so as to urge same out of alignment with slot 28 until pivoted by means of its tab 32 as will be described.

A third slot 33 is formed in a wall of the locket, preferably the back wall 20 thereof as shown in FIG. 2, so that the tab can extend therethrough and be movable therein.

A spring 30, preferably a flat spring, is mounted within the locket and the free end thereof extends without the compartment 24 such upon the insertion of one or more coins into the locket through slot 26 such coins will be engaged by spring 30 and urged for ejection from slot 28. A second spring 32, desirably in the form of a plate spring, is mounted within the locket and is tensioned to exert a biasing force upon the coins therein urging such coins out of vertical alignment with slot 28, thus, the coins are normally prevented from being ejected by the force of spring 30.

As can be seen most clearly from FIG. 2, spring 32 is provided with an outwardly directed shelf portion 34 and a manually operable tab 36. The shelf may desirably extend the full width of the spring so as to provide a support for the coins within the compartment. The tab extends through slot 33 and, when pushed manually, effects a pivotal movement of spring 32 about its other end. Normally spring 32, as stated above, extends angularly across the compartment between the front and back walls of the locket to prevent the ejection of a coin therefrom. However, upon depression of the tab 36 the spring pivots inwardly until the coins align vertically with slot 28 and can be ejected therefrom by means of the bias of spring 30.

The locket is desirably made of metal and can be formed in two halves which may be force fit to form a unitary assembly by means of cooperable lip and edge portions (not shown). It will be understood, of course, that the locket may be made of one of the readily available synthetic plastics materials if so desired.

From the foregoing it will be seen that a coin-carrying locket has been provided which overcomes the failings of prior constructions of this character and which can be easily and relatively inexpensively produced.

I claim:

1. A coin-carrying locket comprising:

front and back walls and a peripherally extending wall connected therebetween to form a coin receiving and storage compartment;

a coin-receiving and a coin-ejection slot formed in spaced relation in said peripherally extending wall;

a first coin-ejection spring mounted within said compartment adapted to engage a coin stored therein and urge said coin towards said ejection slot for discharge therethrough;

a second coin-retaining spring pivotally mounted within said compartment adapted to engage a coin engaged by said coin-ejection spring and to urge the coin out of alignment with said coin-ejection slot to thereby prevent ejection of the coin through said ejection slot, said coin-retaining spring being provided at the free end thereof with a manually operable tab;

and a third slot formed in one of said walls dimensioned of permit said tab to extend therethrough and be shiftable therein, whereby manual shifting of said tab against the bias of said coin-retaining spring effects pivotal movement of said coin-retaining spring and alignment of the coin with said coin-ejection slot for discharge therethrough by said coin-ejection spring.

2. A locket according to claim 1, wherein said coin-ejection spring is a flat spring, said coin-retaining spring is a plate spring and said third slot is formed in one of said front and back locket walls.

3. A locket according to claim 1, wherein said coin-receiving and coin-ejection slots are disposed relative to each other at an angular distance of substantially 90°.

4. A locket according to claim 2, wherein said plate spring extends angularly across said compartment between said front and back walls and is provided with a shelf portion for support of coins within the compartment of the locket.

5. A locket according to claim 1, wherein an upstanding projection is provided having an aperture therein adapted to receive a chain element.

* * * * *